United States Patent [19]

Ball, Jr.

[11] 4,251,792

[45] Feb. 17, 1981

[54] THERMISTOR BONDED TO THERMALLY CONDUCTIVE PLATE

[75] Inventor: George A. Ball, Jr., Cape Elizabeth, Me.

[73] Assignee: GTE Products Corporation, Stamford, Conn.

[21] Appl. No.: 35,562

[22] Filed: May 3, 1979

[51] Int. Cl.[3] ..... H01C 7/04

[52] U.S. Cl. ..... 338/22 R; 338/25

[58] Field of Search ..... 338/22 R, 22 SD, 23–25, 338/28; 73/362 AR; 29/610, 612

[56] References Cited

U.S. PATENT DOCUMENTS

| | | | |
|---|---|---|---|
| 2,405,192 | 8/1946 | Davis | 338/22 X |
| 3,381,253 | 4/1968 | Sapotf et al. | 338/315 X |
| 3,896,409 | 7/1975 | Micheli et al. | 338/28 |
| 4,131,657 | 12/1978 | Ball, Jr. et al. | 338/22 R X |

*Primary Examiner*—C. L. Albritton

*Attorney, Agent, or Firm*—James Theodosopoulos

[57] ABSTRACT

A thermistor assembly comprises a disc type thermistor bonded to a layer of a low expansion alloy which, in turn, is bonded to a thermally conductive plate. Interposition of the low expansion alloy between the thermistor and the plate substantially prevents the formation of hairline cracks in the thermistor that could result from thermal cycling.

4 Claims, 2 Drawing Figures

THERMISTOR BONDED TO THERMALLY CONDUCTIVE PLATE

THE INVENTION

This invention concerns thermistors. U.S. Pat. No. 4,131,657 discloses the use of a thermistor in an electric automotive choke. The thermistor there comprises a ceramic disc, for example, barium titanate, which is bonded to a thermally conductive plate. Fastened to the plate is a coiled bimetallic spring which, when heated, opens the choke valve. The plate is made of a thermally conductive metal, such as brass or aluminum, which has a higher coefficient of thermal expansion than does the ceramic disc. Such a difference in coefficient of thermal expansion can cause a hairline crack across the full length of the thermistor as a result of thermal cycling during repetitive operation. Such a crack can impair proper operation of the thermistor, especially in the case of a double electroded thermistor such as shown in said U.S. Pat. No. 4,131,657.

It is the purpose of this invention to prevent such a crack from occurring in a thermistor bonded to a thermally conductive plate the coefficient of expansion of which is greater than that of the thermistor. In this invention, a layer of a low expansion alloy is bonded between the plate and the thermistor. The low expansion alloy takes up stresses induced by thermal cycling of the plate and eliminates the cracking that would result from such thermal cycling if the thermistor were rigidly bonded directly to the plate. The coefficient of thermal expansion of the low expansion alloy must be less than that of the plate and should be about equal to or less than that of the thermistor.

The layer of low expansion alloy interposed between the thermistor and the thermally conductive plate must be rigidly bonded to each of the thermistor and the plate with a suitable bonding material, such as solder. The low expansion alloy must maintain its original form throughout the bonding process, that is to say, its softening or melting temperature must exceed the maximum temperature that occurs during bonding.

This invention is an improvement over prior art methods of preventing cracking, an example of which is the use of a flexible, thermally and electrically conductive bonding material, for example, a resin that is heavily loaded with conductive particles such as silver. The electrical conductivity of such a material decreases as its temperature rises. Also, it is limited to an operating temperature of about 400° to 500° F. In the instant invention, because there is no organic matter, including silicones, present, the electrical conductivity of the bonding material does not undergo a similar decrease with increasing temperature. For the same reason, the operation temperature can exceed 500° F.

Figure 1:
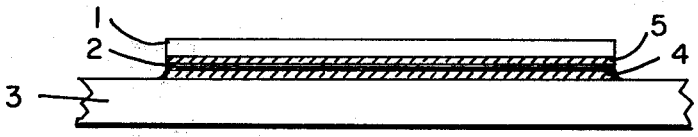
FIG. 1 is a cross sectional view of a thermistor bonded to a thermally conductive plate in accordance with this invention.

The thermistor assembly in FIG. 1 comprises a thermistor 1, a low expansion alloy 2 and a thermally conductive plate 3. Solder joints 4 and 5 bond low expansion alloy 2 to plate 3 and thermistor 1 respectively.

Figure 2:
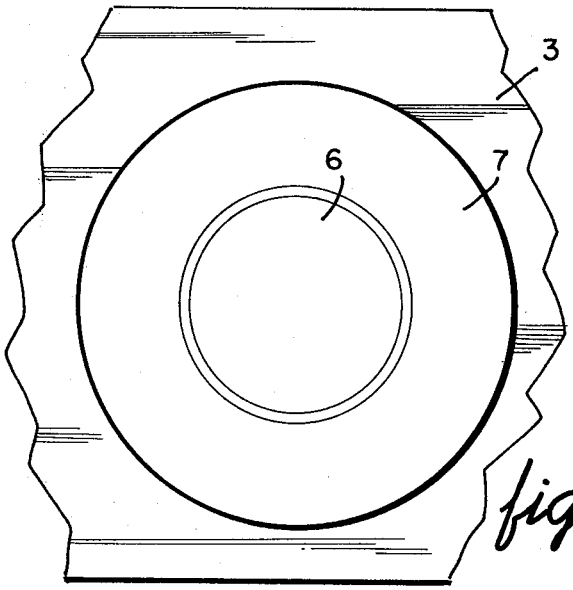
FIG. 2 is a plan view thereof.

FIG. 2 shows the double electrode configuration, with inner electrode 6 and outer electrode 7 comprising separated conductive metallic coatings bonded to the face of thermistor 1 in known manner, as disclosed, for example, in U.S. Pat. No. 3,793,604. A double electroded thermistor is particularly affected by thermal cycling because its metallic coatings are quite thin, being screen printed silver paste on electroless nickel, and are therefore more likely to crack than thicker electrodes made, for example, of plasma sprayed aluminum-copper. Cracking reduces the effective area of the thermistor and, therefore, upsets normal operation.

In one example, thermally conductive plate 3 was substantially circular, about 30 mm in diameter by 56 mils thick, and was made of aluminum, copper-clad for solderability, the coefficient of thermal expansion of which was about $21\times10^{-6}$ in/in/°C. Low expansion alloy 2 was a disc 22 mm in diameter by 12 mils thick and was made of a low thermal expansion nickel iron alloy having a coefficient of thermal expansion of about $4\times10^{-6}$ in/in/°C. Thermistor 1 was made of barium titanate and was about 21 mm in diameter by 50 mils thick and had a coefficient of thermal expansion of about $9.5\times10^{-6}$ in/in/°C. The solder used for bonding was in the form of discs and consisted of 10% tin, 88% lead and 2% silver, the melting point of which was 554° F. Bonding was effected by placing solder disc 4 between plate 3 and alloy 2 and solder disc 5 between alloy 2 and thermistor 1, and heating the assembly in an oven at 600° F.

Electrode 6 had a diameter of 5 mm and electrode 7 was separated therefrom by a circular band devoid of metallic conductive coating that was about 1 mm wide. Thus the area of electrode 7 was about 192 square mm and the area of electrode 6 was about 79 square mm.

It is believed that the reason why the coefficient of thermal expansion of low expansion alloy 2 can be less than that of thermistor 1, as well as about equal thereto, is because heating of the assembly in such a case results in a compressive stress on thermistor 1. The thermistor, being ceramic, can withstand such compressive stresses without cracking.

I claim:

1. A thermistor assembly comprising a disc type thermistor, a layer of a low thermal expansion alloy rigidly bonded to the thermistor, said layer of low thermal expansion alloy comprising a disc of an alloy containing nickel and iron, and a thermally conductive plate rigidly bonded to the low thermal expansion alloy, the coefficient of thermal expansion of the thermally conductive plate being greater than that of the thermistor, the coefficient of thermal expansion of the thermal expansion alloy being about equal to or less than that of the thermistor, whereby cracking of the thermistor as a result of thermal cycling during normal operation is substantially eliminated.

2. The thermistor assembly of claim 1 wherein the thermistor has an electrode on its face comprising a thin conductive metallic coating.

3. The thermistor assembly of claim 1 wherein the disc of low thermal expansion alloy is soldered to the thermally conductive plate and to the thermistor.

4. The thermistor assembly of claim 3 wherein the melting point of the low thermal expansion alloy is greater than the soldering temperature of the solder.

* * * * *